US005490824A

United States Patent [19]

Wang

[11] Patent Number: 5,490,824

[45] Date of Patent: Feb. 13, 1996

[54] LIMB EXERCISER

[76] Inventor: Chih C. Wang, 2F., No. 3, Lane 280, Chung-Chan Rd., Hsin Tien City, Taipei Hsien, Taiwan

[21] Appl. No.: 357,611

[22] Filed: Dec. 13, 1994

[51] Int. Cl.[6] ..... A63B 22/06

[52] U.S. Cl. ..... 482/60; 482/64; 482/119; 601/36

[58] Field of Search ..... 482/57, 60, 63, 482/65, 79, 114, 115, 119, 904; 601/36

[56] References Cited

U.S. PATENT DOCUMENTS 3,100,640 8/1963 Weitzel ..... 482/60
4,390,177 6/1983 Biran et al. ..... 482/60
5,108,092 4/1992 Hurst ..... 482/60
5,312,312 5/1994 Fernandez et al. ..... 482/60

*Primary Examiner*—Richard J. Apley
*Assistant Examiner*—Jeanne M. Clark

[57] ABSTRACT

Disclosed is a limb exerciser mainly including an outer wheel housing and an inner wheel set in the outer wheel housing. With frictional members disposed between the contact surfaces of the outer wheel housing and the inner wheel, as well as actuating members oppositely disposed at two sides of the inner wheel, the inner wheel can be rotated relative to the outer wheel housing by pushing or pedalling the actuating members to produce frictional force or resistance and thereby helps the user to conveniently take hand or foot exercise at a desk top or on a floor or ground.

2 Claims, 5 Drawing Sheets

LIMB EXERCISER

BACKGROUND OF THE INVENTION

The present invention relates to a limb exerciser, and more particularly to a simple, convenient, and portable limb exerciser of which an inner wheel is turned by either the feet or the hands of a user to frictionally contact a housing of the exerciser to produce rotation resistance.

A diversity of new exercising equipments are constantly researched and developed due to the need in physiotheraphy and the limited places available for outdoor sports. One of such exercising equipments is the exerciser bicycle which is generally used as a physical fitness equipment and/or a rehabilitation exerciser. Such exerciser bicycle must be located at some place for use and storage while it is not easily portable and can not be used by hands. That is, such exerciser bicycle has only limited function and therefore, can not meet the nowaday need in the multipurpose exerciser. Most equipments for hand exercise or hand rehabilitation are separately designed and manufactured.

Another factor that prevents people from taking exercise constantly is that the exercise is frequently interrupted by trip, limited place, etc. Moreover, the quantity of exercising equipments in hospitals for physiotheraphy is usually out of proportion to the numbers of patients requiring such equipments.

It is therefore desirable to develop an exercising equipment which is easily portable, suitable for use at any place, and can be manufactured and purchased at low cost.

SUMMARY OF THE INVENTION

A primary object of the present invention is to provide a limb exerciser which is simple in the structure and easily portable for use at any place to assist general consumers in properly adjusting their physical conditions.

Another object of the present invention is to provide a limb exerciser which is a multipurpose exercising aid and can be made with easily available materials and designed to meet the ergonomics and safety requirement to ensure the safe use thereof by any user.

The limb exerciser according to the present invention mainly includes a wheel housing and an inner wheel. The inner wheel is turned by either the feet or the hands of a user to frictionally contact the wheel housing of the exerciser to produce rotation resistance so that the feet or the hands of the user are properly trained and strengthened.

BRIEF DESCRIPTION OF THE DRAWINGS

The above and other objects and the features and functions of the present invention can be best understood by referring to the following detailed description of the preferred embodiments and the accompanying drawings, wherein.

DETAILED DESCRIPTION OF THE PREFERRED EMBODIMENTS

Figure 1:
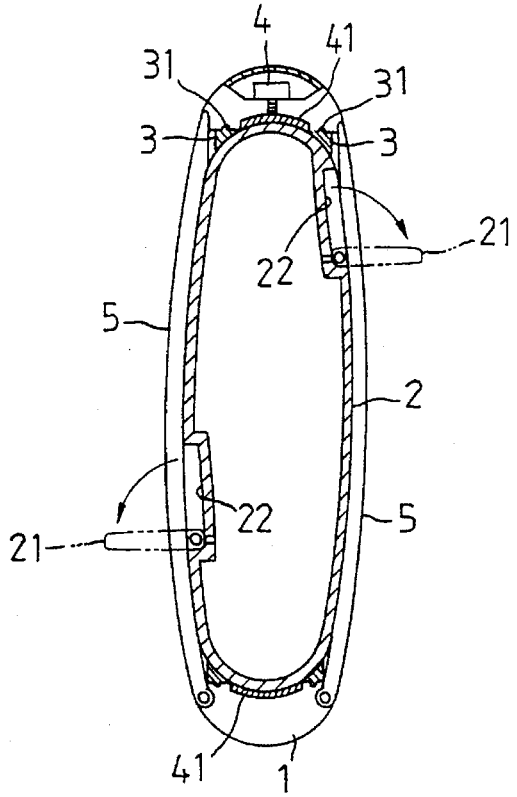
FIG. 1 is a front sectional view of the present invention.
Figure 2:
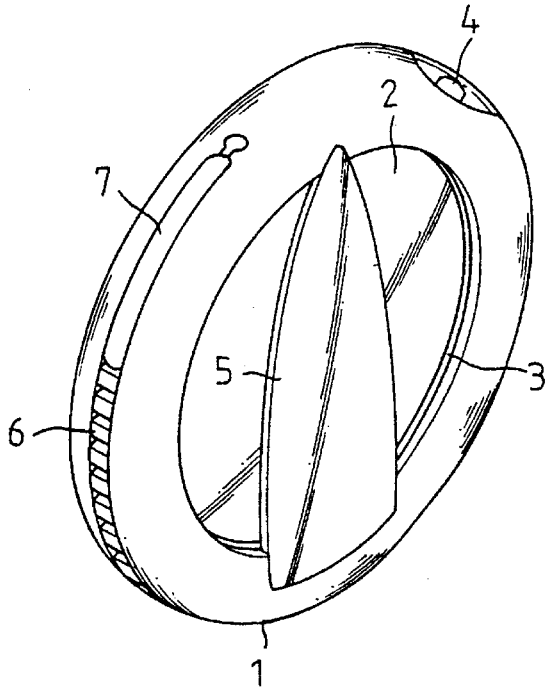
FIG. 2 is a perspective view of the present invention.
Figure 3:
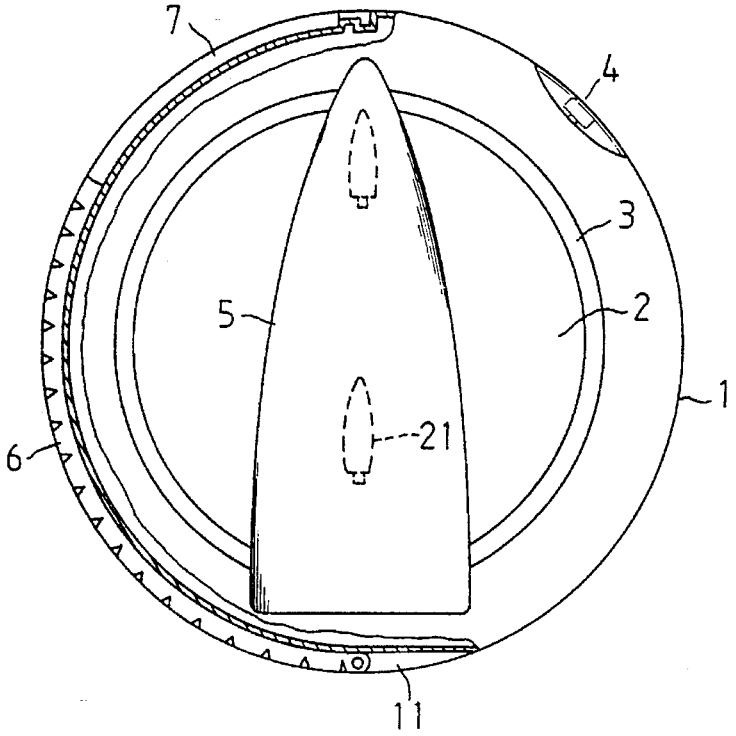
FIG. 3 is a side view of the present invention, a part of which is cut off to better show the structure thereof.
Figure 4:
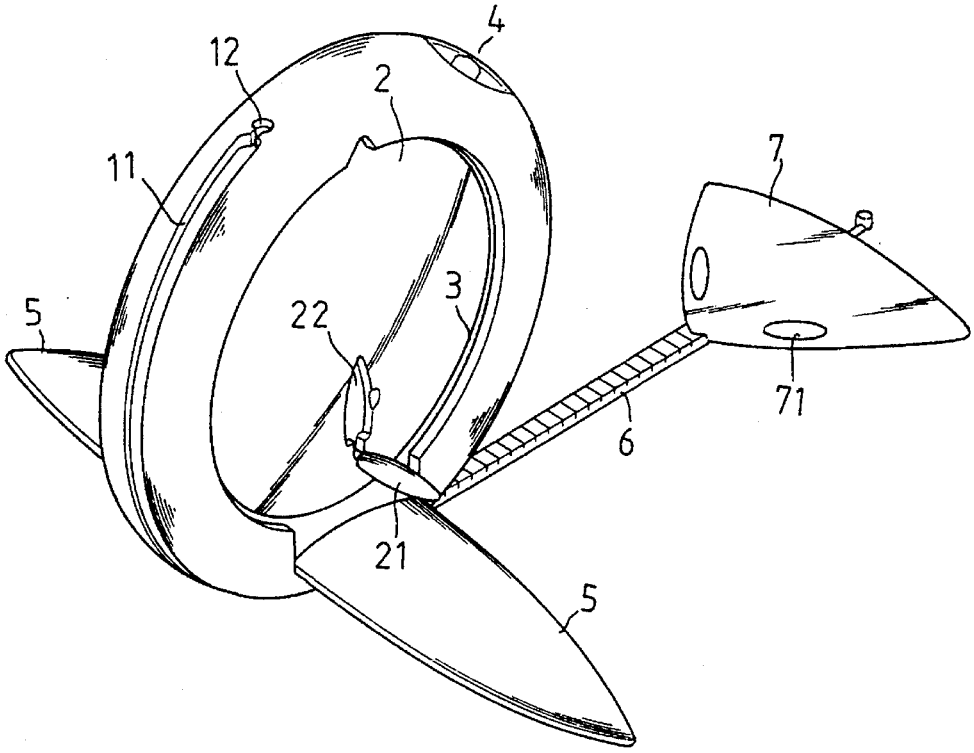
FIG. 4 is a perspective view of the present invention with the extension wings, the actuating members, and the track thereof in an extended position.

Please refer to FIGS. 1, 2, 3 and 4. A limb exerciser according to the present invention mainly includes an outer wheel housing 1 made of somewhat rigid material and in a form of annular member, a resilient and flexible inner wheel tightly but rotatably set in the space defined by the outer wheel housing 1, two wheel rims 3 disposed at two sides of the outer wheel housing 1 to fix the inner wheel 2 in place by means of a flange 31 circumferentially provided around each wheel rim 3, two extension wings 5 pivotally connected to two sides of the outer wheel housing 1 near a bottom central portion thereof, a track 6, and a pad 7 attached to one free end of the track 6.

The inner wheel 2 is provided at each side with an opening 22 to pivotally connect and receive an actuating member 21 therein. The two openings 22 and accordingly the two actuating members 21 are disposed at two sides of the inner wheel 2 at diametrically opposite positions. Two friction members 41 are diametrically oppositely disposed between the contact surfaces of the outer wheel housing 1 and the inner wheel 2. One of the two friction members 41 is connected to a threaded stem. The threaded stem has an adjusting nut 4 connected to a free end thereof. The nut 4 just projects out of an opening formed on the outer wheel housing 1. By means of turning the adjusting nut 4, the frictional force or the resistance produced when the inner wheel 2 is rotated relative to the outer wheel housing 1 can be changed as necessary. A receiving groove 11 is formed on the circumferential surface of the outer wheel housing 1 to extend a predetermined length for receiving the track 6 therein. The receiving groove 11 is further provided at a first end near a top side of the outer wheel housing 1 with an ear slot 12. The track 6 is pivotally connected at one end to a second end of the receiving groove 7 opposite to the first end thereof and can be turned about the pivot to be received in the groove 11 with its projected free end received and stopped in the ear slot 12. The pad 7 is made of soft and thin material so that it may be rolled up about the track 6 and be received in the groove 11, too. To take out the rolled-up pad 7 and the track 6 from the groove 11, simply lift the projected free end of track 6 out of the ear slot 12, turn the track 6 outward about the pivot at the other end until the track 6 is pulled to flatly extend behind the outer wheel housing 1. The pad 7 can be spread at this point. To use the limb exerciser of the present invention, pull the two extension wings 5 outward about their respective pivot to help the limb exerciser to be stably seated on a plane in an upright position. Then, the two actuating members 21 are pivotally turned to extend from their respective opening 22 in a horizontal position relative to the inner wheel 2. When the actuating members 21 are alternately pushed or pedalled by the user with hands or feet, respectively, the inner wheel 2 is rotated relative to the outer wheel housing 1. Due to the friction members 41 oppositely disposed between the contact surfaces of the inner wheel 2 and the outer wheel housing 1 as well as the adjusting nut 4 and the threaded stem connected to one of the friction members 4, an adjustable frictional force or resistance is produced during the rotation of the inner wheel 2 relative to the outer wheel housing.

Figure 5A:
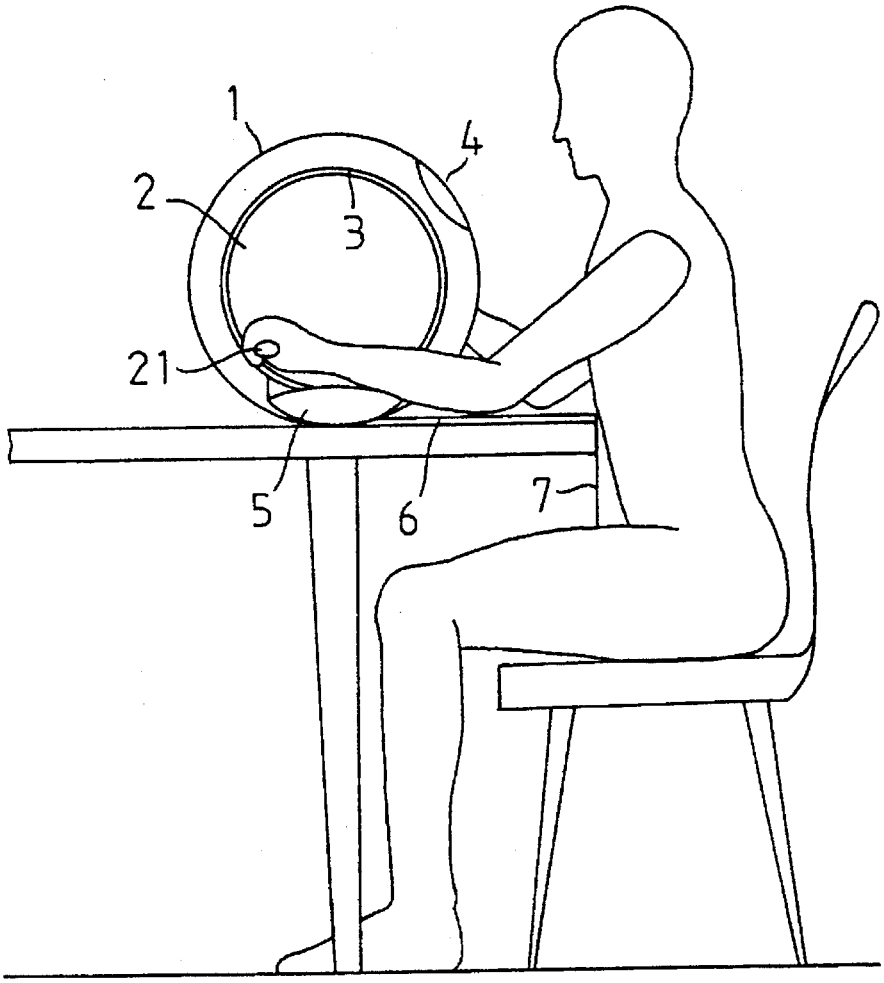
FIGS. 5A, 5B, and 5C illustrate different manners in which the present invention can be operated.

Please refer to FIG. 5A. When a hand exercise is desired, the limb exerciser of the present invention can be prepared according to the above-mentioned procedures and then be positioned on a table or desk top. The user may grip the two actuating members 21 with his/her hands to rotate the inner wheel 2 to achieve the purpose of hand exercise. The rotational resistance produced during the turning of the inner wheel 2 can be increased or decreased by means of turning the adjusting nut 4 to change the frictional contact of the friction members 41 on the inner wheel 2 with the outer wheel housing 1.

Figure 5B:
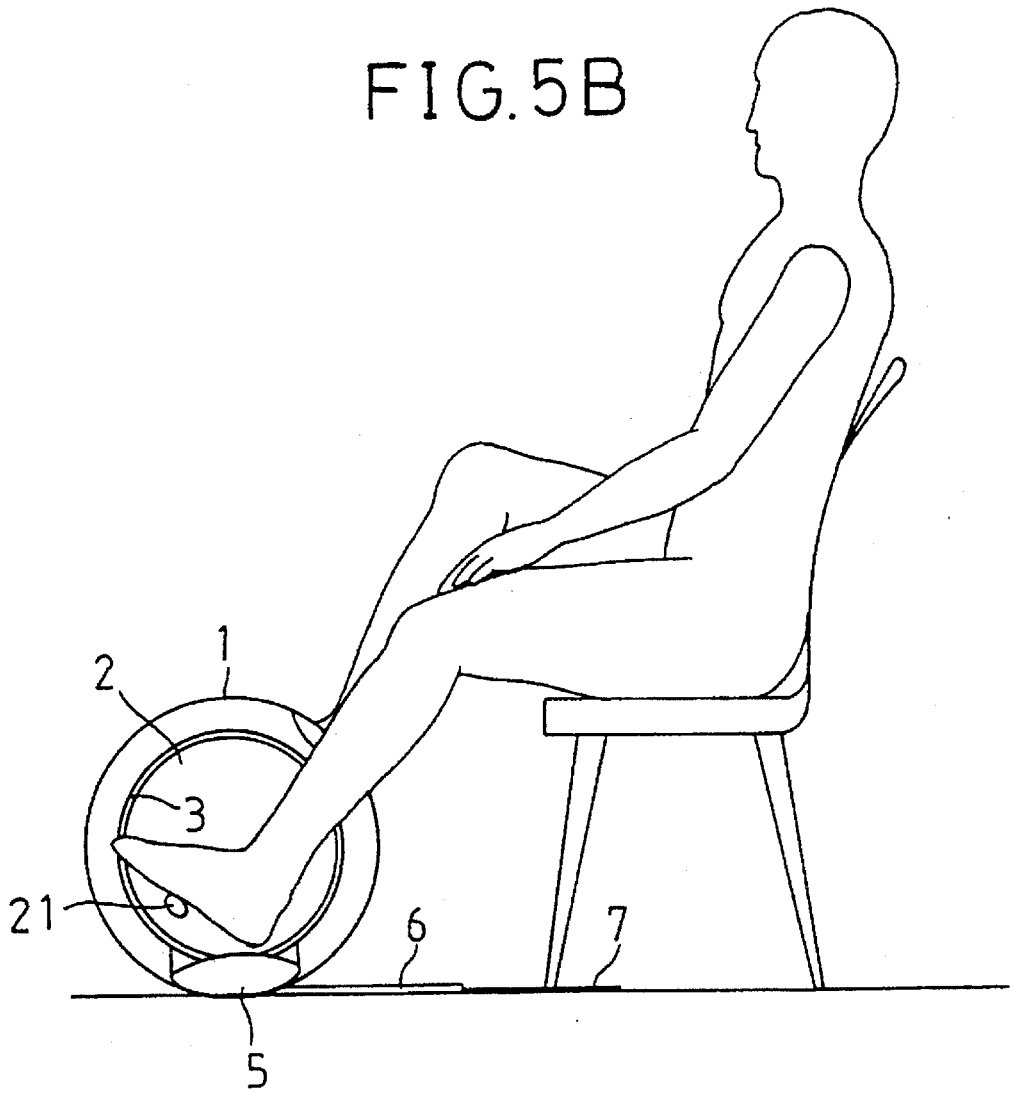

Please now refer to FIG. 5B. When a foot or leg exercise is desired, the limb exerciser can be prepared in the same manner as it is to be used for a hand exercise. Then, the limb exerciser is positioned on the ground, the track 6 is extended, and the pad 7 is spread and positioned below a chair to be firmly pressed and fixed in place by the legs of chair, such that an adequate distance is left between the exerciser and the user to best operate the exerciser. Then, the actuating members 21 are alternately pedalled by the user with his/her feet to achieve the foot exercise.

Figure 5C:
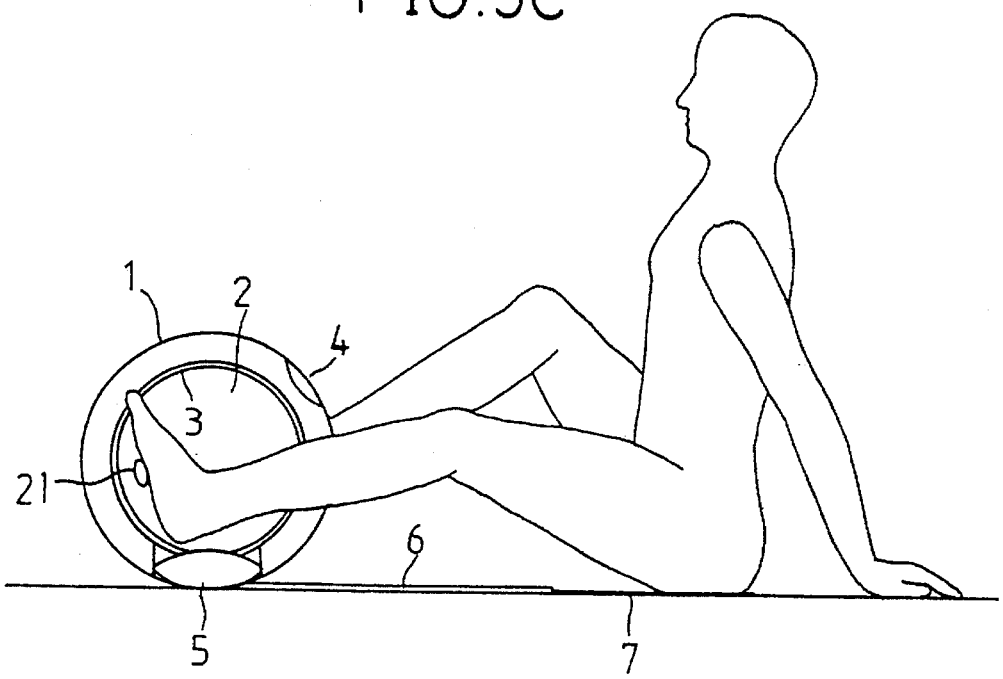

The limb exerciser may also be used to achieve the foot exercise when the user sits on the floor or ground as shown in FIG. 5C. The pad 7 is firmly pressed in place by the user's buttocks in this case while the two actuating members 21 are alternately pedalled by the user. The pad 7 may be provided at suitable positions with hand openings 71 to facilitate the position adjustment of the pad 7 by the user.

What is claimed is:

1. A limb exerciser comprising a semi-rigid outer wheel housing and a resilient and flexible inner wheel, said inner wheel being tightly but rotatably set in a space defined by said outer wheel housing and being fixed in place by means of two circumferentially flanged wheel rims disposed at each side of said outer wheel housing, characterized in that two extension wings are pivotally connected to two sides of said outer wheel housing at a bottom central portion thereof such that said extension wings can be pivotally extended outward to a horizontal position relative to said outer wheel housing, that two openings are formed at two sides of said inner wheel at diametrically opposite positions so as to each pivotally connect and receive an actuating member therein, that two friction members are disposed between circumferential contact surfaces of said inner wheel and said outer wheel housing at diametrically opposite positions with one of said friction members being connected to a and an adjusting nut which, when being turned by rotating said adjusting nut provided at a top thereof, can change the frictional force produced when said inner wheel rotates in and relative to said outer wheel housing, that said outer wheel housing includes a track, a pad and a receiving groove of proper length and an ear slot extended from a first end of said receiving groove to receive a track pivotally connected to a second end of said receiving groove with a projected end of said track received and stopped in said ear slot, and that said pad which can be rolled up about said track is attached to a free end of said track.

2. A limb exerciser as claimed in claim 1, wherein said pad is provided with hand openings.

* * * * *